US011833566B2

(12) United States Patent
Garnier

(10) Patent No.: US 11,833,566 B2
(45) Date of Patent: Dec. 5, 2023

(54) METHOD AND DEVICE FOR MANUFACTURING A PART FROM A PLATE MADE OF A FORMABLE MATERIAL, IN PARTICULAR FOR THE EDGE OF AN ELEMENT OF AN AIRCRAFT

(71) Applicant: Airbus Operations (S.A.S.), Toulouse (FR)

(72) Inventor: César Garnier, Toulouse (FR)

(73) Assignee: Airbus Operations (S.A.S.), Toulouse (FR)

( * ) Notice: Subject to any disclaimer, the term of this patent is extended or adjusted under 35 U.S.C. 154(b) by 0 days.

(21) Appl. No.: 17/871,376

(22) Filed: Jul. 22, 2022

(65) Prior Publication Data

US 2023/0061707 A1 Mar. 2, 2023

(30) Foreign Application Priority Data

Aug. 5, 2021 (FR) ..... 2108531

(51) Int. Cl.
*B21D 26/033* (2011.01)
*B21D 37/16* (2006.01)

(52) U.S. Cl.
CPC ..... *B21D 26/033* (2013.01); *B21D 37/16* (2013.01)

(58) Field of Classification Search
CPC .... B21D 26/02; B21D 26/033; B21D 26/047; B21D 37/16; B21D 53/26
See application file for complete search history.

(56) References Cited

U.S. PATENT DOCUMENTS

2007/0084538 A1 4/2007 Nakazawa et al.
2019/0161819 A1* 5/2019 Werbs ..... B21D 26/033

FOREIGN PATENT DOCUMENTS

| | | | |
|---|---|---|---|
| CN | 113 020 391 | A | 6/2021 |
| EP | 0581458 | A2 | 2/1994 |
| EP | 1 256 397 | A | 11/2002 |
| EP | 1 306 145 | A1 | 5/2003 |
| EP | 3 485 996 | A1 | 5/2019 |
| FR | 2 132 483 | A1 | 11/1972 |

(Continued)

OTHER PUBLICATIONS

French Search Report for Application No. 2108531 dated Mar. 31, 2022.

(Continued)

*Primary Examiner* — Teresa M Ekiert
(74) *Attorney, Agent, or Firm* — KDW Firm PLLC

(57) ABSTRACT

Method and device for manufacturing a component from a plate made of deformable material, in particular for an edge of an element of an aircraft. The device includes a tool with two tool parts configured to be able to move closer to one another and are able to round a plate made of deformable material fixed to the two tool parts, a mold at the periphery of the tool and including a molding cavity of a shape corresponding to the shape of the component that is to be manufactured, and a displacement system configured to press the rounded plate firmly against the molding cavity of the mold, the mold being able to shape the rounded plate when it is pressed firmly against the molding cavity to give it its definitive shape, the device allowing the manufacture of single-piece components of varying sizes and notably large-sized components and/or deep components.

13 Claims, 4 Drawing Sheets

(56) References Cited

FOREIGN PATENT DOCUMENTS

| | | | |
|---|---|---|---|
| FR | 2 975 929 | A1 | 12/2012 |
| KR | 2020 0127319 | A | 11/2020 |

OTHER PUBLICATIONS

French Search Report for Application No. 2108538 dated Apr. 4, 2022.
European Search Report for Application No. 22184523 dated Jul. 22, 2022.
European Search Report for Application No. 22184524 dated Jul. 22, 2022.

* cited by examiner

METHOD AND DEVICE FOR MANUFACTURING A PART FROM A PLATE MADE OF A FORMABLE MATERIAL, IN PARTICULAR FOR THE EDGE OF AN ELEMENT OF AN AIRCRAFT

CROSS-REFERENCE TO RELATED APPLICATION

This application claims priority to French patent application number 2108531 filed on Aug. 5, 2021, the entire disclosure of which is incorporated by reference herein.

TECHNICAL FIELD

The disclosure herein relates to a method and a device for manufacturing components made of a deformable material, particularly for an edge of an element of an aircraft.

BACKGROUND

Although not exclusively, the disclosure herein applies more particularly to the manufacture of a component intended for any type of edge, notably a leading edge, of an element, particularly of an aircraft, and notably of a transport airplane. This may notably be an external (so-called aerodynamic) element of the aircraft, such as an aerodynamic surface (wing, stabilizer, etc.) or a propulsion system, or an element internal to the aircraft.

At the present time, such components are generally manufactured from an aluminum alloy. The manufacture requires numerous successive steps with heat treatments. Such manufacture is lengthy and costly.

In particular, the usual methods of manufacture are greatly limited in the manufacture of one-piece components. In particular, they are unable to form components of very large size or deep components.

There is therefore a need for a solution enabling the manufacture of (one-piece) components notably intended for the aforementioned applications, which have various sizes and/or shapes, and in particular very large-sized components and/or deep components.

SUMMARY

It is an object of the disclosure herein to address this need. To do that, the disclosure herein relates to a device for manufacturing at least one component made of deformable material, particularly for an edge of an element of an aircraft.

According to the disclosure herein, the manufacturing device comprises:

- a tool provided with two tool parts of which at least one is mobile, these two tool parts being configured so as to be able to move closer to one another and being able to round a plate made of deformable material which is fixed by two of its ends to the two tool parts respectively when these two tool parts are moved closer to one another;
- a mold arranged at the periphery of the tool and provided with a molding cavity of a shape corresponding to the shape of at least part of the component that is to be manufactured, the molding cavity being oriented in such a way as to face the rounded plate; and
- a displacement system configured to press the rounded plate firmly against the molding cavity of the mold, the mold being able to shape the rounded plate when it is pressed firmly against the molding cavity so as to give it its definitive shape.

Thus, by virtue of the creation of a rounded sheet that is used for being subjected to forming in the mold and by virtue of the layout of the mold provided with the molding cavity at the periphery of the tool, making it possible to envision various embodiments notably suited to the components that are to be manufactured, it becomes possible, using the manufacturing device, to manufacture (single-piece) components of varying size, and notably large-sized components and/or deep components.

In one particular embodiment, the tool comprises at least one of the following actuating systems for moving the two tool parts closer to one another: a mechanical system, a hydraulic system.

Advantageously, the displacement system comprises at least one of the following units: a fluid supply unit (which uses an external fluid), a fluid displacement unit (which uses a fluid which is internal to the tool and is displaced as the two tool parts move closer together).

Moreover, in one particular embodiment, the mold comprises a plurality of shell parts able to be separated and assembled, which are connected to the tool in one of the following ways:

- at least one of the shell parts is fixed to one of the tool parts;
- at least one of the shell parts is connected in a mobile manner to one of the tool parts Furthermore, in another embodiment, the mold comprises a plurality of shell parts able to be separated and assembled, and the manufacturing device comprises an auxiliary actuation system configured to be able to displace the shell parts in order to assemble them.

Moreover, in one preferred embodiment, the molding cavity of the mold has a shape that allows at least two components to be manufactured simultaneously. The manufacture performed by the manufacturing device can be performed cold. However, in one particular embodiment, the manufacturing device additionally comprises an oven able to heat at least the plate. This particular embodiment allows hot manufacture.

The disclosure herein also relates to a method for manufacturing at least one component made of deformable material, particularly for an edge of an element of an aircraft.

According to the disclosure herein, the manufacturing method comprises at least the following steps:

- a deformation step consisting in or comprising fixing a plate made of deformable material by two of its ends respectively to two tool parts of a tool and in bringing the two tool parts closer to one another in order to round the plate; and
- a forming step consisting in or comprising pressing the rounded plate firmly against a molding cavity of a mold arranged at the periphery of the tool, the molding cavity having a shape corresponding to the shape of at least part of the component that is to be manufactured and being oriented in such a way as to face the rounded plate so as to shape the rounded plate in order to give it its definitive shape.

In the context of the disclosure herein, the forming step can be performed after the deformation step. However, in a preferred embodiment, the deformation step and the forming step are performed at least partially simultaneously.

The manufacture performed by the manufacturing method can be performed cold. However, in one particular embodiment, at least the forming step is performed hot, and as a preference both the deformation step and the forming step are performed hot.

BRIEF DESCRIPTION OF THE DRAWINGS

The attached figures will make it easy to understand how the disclosure herein may be embodied. In these figures, identical references denote elements that are similar.

DETAILED DESCRIPTION

Figure 1:
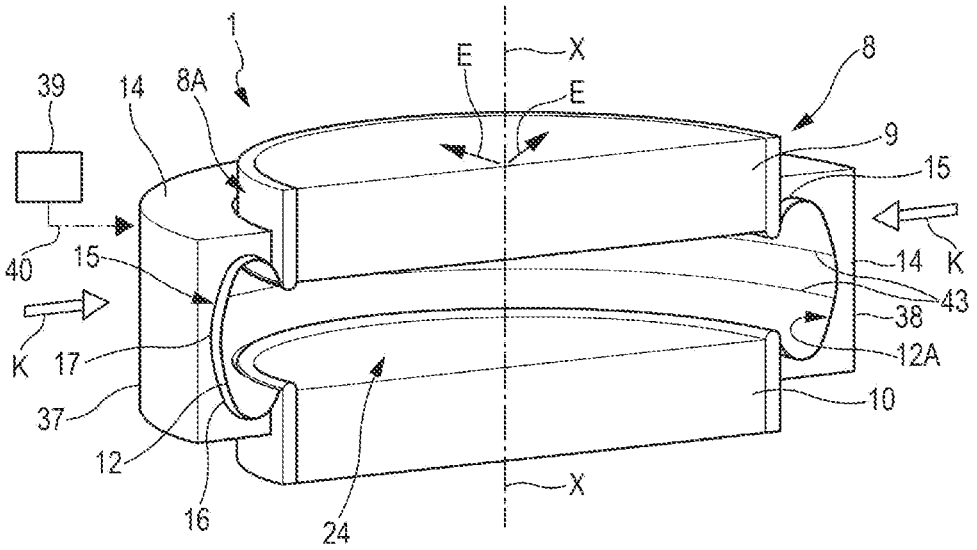
FIG. 1 is a partial view, in perspective and in section, of one particular embodiment of a manufacturing device.
Figure 2:
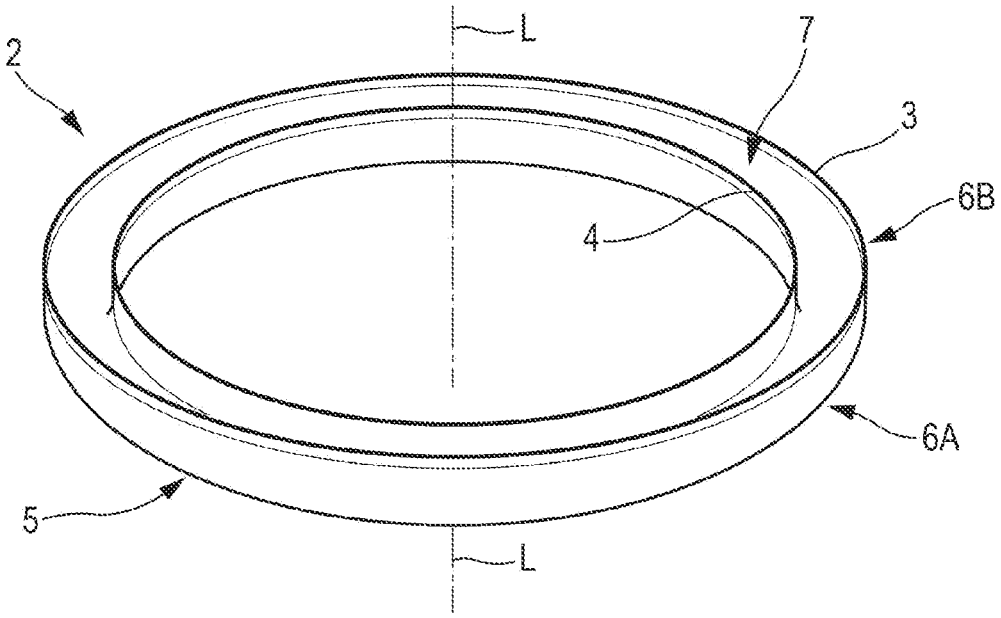
FIG. 2 is a perspective view of a component manufactured using the manufacturing device of FIG. 1.

The device 1 depicted schematically in FIG. 1 and illustrating the disclosure herein is a device for manufacturing a component 2 made of a deformable material, such as the one depicted by way of illustration in FIG. 2.

In the context of the disclosure herein, the component 2 may correspond to a component intended to be arranged on an element, particularly of an aircraft, and notably of a transport airplane. The component 2 is generally arranged on an edge of the element, and mainly although not exclusively on the leading edge thereof, and may for example correspond to an air intake lip. Regarding the element on which the component is arranged, this may notably be a (so-called aerodynamic) element external to the aircraft, such as an aerodynamic surface (wing, stabilizer, etc.) or a propulsion system, or an element internal to the aircraft.

The component 2 depicted by way of illustration in FIG. 2 has an annular overall shape with symmetry of revolution about an axis L-L. The component 2, which is U-shaped in transverse section, is provided with two longitudinal walls 3 and 4 which are joined together by a rounded bottom 5, at one of the longitudinal ends 6A. At the other longitudinal end 6B of the component 2, there is an opening 7.

Figure 3:
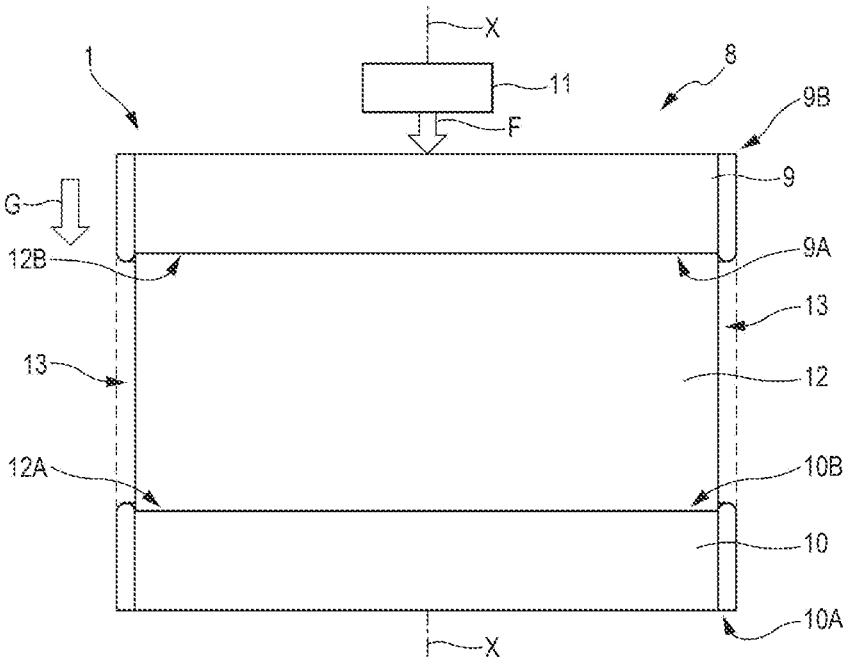
FIG. 3 is a schematic view in section of one particular embodiment of a tool of a manufacturing device.

To manufacture the component 2, the device 1 comprises a tool 8 provided, as depicted in FIG. 3, with two tool parts 9 and 10. These two tool parts 9 and 10 are configured so as to be able to move closer to one another. To do this, at least one of the two tool parts 9 and 10 is mobile.

The tool 8 has a longitudinal axis X-X. In one particular embodiment, the tool parts 9 and 10 have symmetry of revolution about this longitudinal axis X-X.

In the following description:

"longitudinal" means an element arranged along the longitudinal axis X-X or in a direction parallel to this longitudinal axis X-X;

"radially external" and "radially toward the outside" mean directions that are radial to the longitudinal axis X-X, moving away from the longitudinal axis X-X as illustrated by arrows E in FIG. 1;

"radially internal" and "radially toward the inside" mean directions that are radial to the longitudinal axis X-X, moving toward the longitudinal axis X-X, namely in the opposite direction to the direction illustrated by the arrows E in FIG. 1.

The tool 8 also comprises usual structure, notably a set of rails 13 (FIG. 3), making it possible to guide the mobile tool part or parts 9 and 10 when these tool parts 9 and 10 are moving closer to one another.

The tool 8 also comprises an actuation system 11 configured to generate a force allowing the two tool parts 9 and 10 to be moved closer to one another. The action of the actuation system 11 on the tool 8 is illustrated by an arrow F in FIG. 3.

In the particular embodiment of FIG. 3:

the tool part 10 is fixed. It is, for example, installed on a usual support which has not been depicted; and the tool part 9 is mobile. The tool part 9 can be displaced in the direction shown by an arrow G under the action (illustrated by the arrow F) of the actuation system 11.

In a first particular embodiment, the actuation system 11 is a mechanical system for generating a mechanical action or pressure intended to move the mobile tool part 9 closer to the fixed tool part 10. This mechanical system may, for example, be provided with a piston configured to push the mobile tool part 9.

Furthermore, in a second particular embodiment, the actuation system 11 is a hydraulic system using an injection of fluid (liquid or gas) to generate a hydraulic pressure intended to move the mobile tool part 9 closer to the fixed tool part 10.

Moreover, in a third particular embodiment, the actuation system 11 is a vacuum system using a "vacuum" pump to draw in the fluid (liquid or gas) and generate an action intended to move the mobile tool part 9 closer to the fixed tool part 10.

The tool part 9 comprises longitudinal ends 9A and 9B and the tool part 10 comprises longitudinal ends 10A and 10B. In the example of FIG. 3, the tool parts 9 and 10 are arranged in such a way that their longitudinal ends 9A and 10B face one another.

The component 2 is produced from a plate 12, for example a sheet, made of deformable material specified hereinbelow. To do this, the plate 12 is fixed to the tool 8 of the device 1. More specifically, the plate 12, for example a tubular portion having two longitudinal ends 12A and 12B, is fixed, as depicted in FIG. 3:

by one 12A of its longitudinal ends to the longitudinal end 10B of the tool part 10; and by the other longitudinal end 12B to the longitudinal end 9A of the tool part 9.

These fixings may, for example, be performed by gripper systems able by gripping to hold the longitudinal ends 12A and 12B of the plate 12 on the tool parts 9 and 10, for example using backplates (not depicted) screwed to the longitudinal ends 9A and 10B of the tool parts 9 and 10, trapping the longitudinal ends 12A and 12B of the plate 12, or by other conventional mechanical structure.

Figure 4:
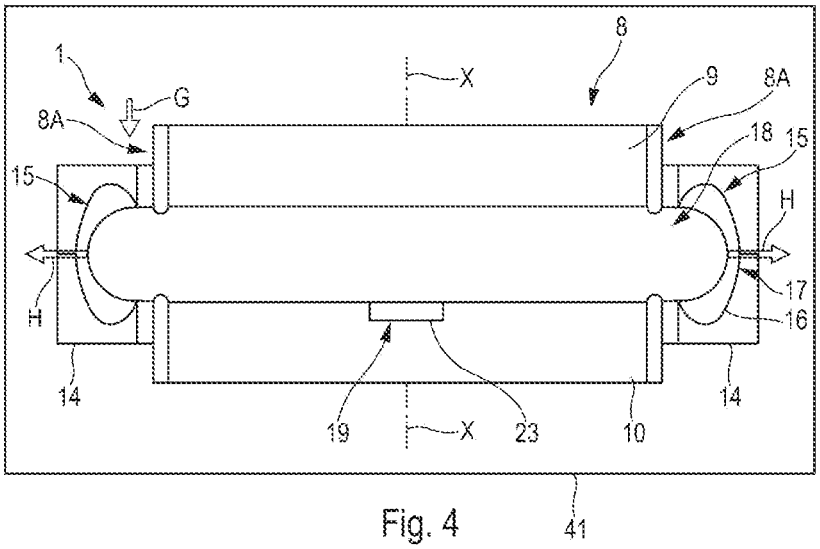
FIG. 4 is a schematic view in section of a manufacturing device comprising a mold according to a first embodiment.

When the plate 12 is fixed by its ends 12A and 12B to the tool 8 in the abovementioned manner, and the two tool parts 9 and 10 are moved closer to one another, notably when the tool part 9 is moved closer to the tool part 10 as illustrated by the arrow G in FIG. 3, the plate 12 (made of a deformable material) is deformed in the directions illustrated by arrows H in FIG. 4, namely radially to the longitudinal axis X-X in a direction away from this longitudinal axis X-X, namely radially toward the outside.

More specifically, the plate 12 is then rounded and dished, as visible in FIG. 4.

In the context of the disclosure herein, what is meant by a deformable material is a material that is able to be subjected to plastic deformation. This deformation may be performed chiefly without any change to the chemical state of the material. In a preferred application, the material is a metallic material and notably a titanium alloy or an aluminum alloy.

The device 1 also comprises, as depicted in FIGS. 1 and 4 in particular, a mold 14 arranged at the periphery 8A of the tool 8, radially around the tool 8.

The mold 14 is provided with a (hollow) molding cavity 15 of a shape corresponding to the shape of the component that is to be manufactured.

In the example of FIG. 4, the molding cavity 15 has the form of an annular cavity of which the internal face 16 is provided with a bottom 17 and opens onto an opening 18. The mold 14 with its molding cavity 15 is arranged in such a way that the opening 18 is oriented in such a way as to face the rounded plate 12, namely radially toward the inside. Thus, the plate 12 can enter the molding cavity 15 via the opening 18 as depicted in FIG. 4 so as to be pressed firmly against the internal face 16 of the molding cavity 15 as far as the end wall 17 as depicted in FIG. 1.

The device 1 also comprises, as shown schematically in FIG. 4, a displacement system 19 configured to generate an action intended to push the plate 12 radially toward the outside, as illustrated by the arrows H. The aim of this action is to act on the rounded plate 12 in order to deform it until it becomes pressed firmly against the internal face 16 of the molding cavity 15 of the mold 14 so that it conforms to the shape of the internal face 16, as shown in FIG. 1. Such an action therefore allows the rounded plate 12 (made of deformable material) to be deformed through plastic deformation in order to give it the shape of the molding cavity 15, which represents the definitive shape of a significant proportion of the component 2 that is to be manufactured or of the entirety of the component 2 that is to be manufactured.

Figure 5:
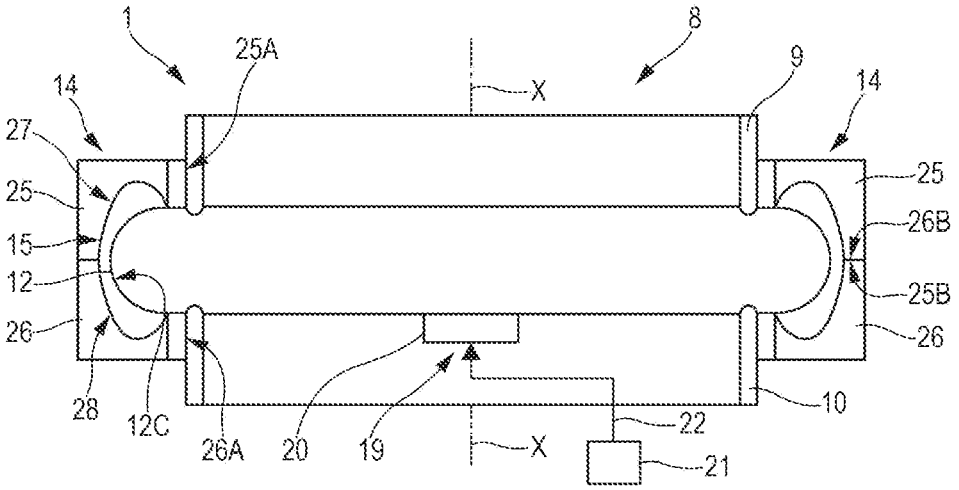
FIG. 5 is a schematic view in section of a manufacturing device comprising a mold according to the first embodiment and a fluid supply unit.

In a first embodiment, depicted in FIG. 5, the displacement system 19 comprises a fluid supply unit 20. This fluid supply unit 20 uses a fluid (liquid or gas) external to the tool 8 and to the mold 14 and which is stored in a tank 21 and transmitted via a pipe 22. The fluid supply unit 20 is configured to inject an increasing volume of this fluid into a closed chamber of the tool 8 that is formed, for example, by the tool parts 9 and 10 and by the plate 12, so as to generate a pressure on the radially internal face 12C of the plate 12 so as to push the plate 12 against the molding cavity 15.

Furthermore, in a second embodiment, depicted schematically in FIG. 4, the displacement system 19 comprises a fluid displacement unit 23. This fluid displacement unit 23 uses a fluid (liquid or gas) situated inside a closed cavity 24 (FIG. 1) inside the tool 8. The cavity 24 is formed by the plate 12 and the tool parts 9 and 10. The fluid displacement unit 23 is configured so that when the two tool parts 9 and 10 move closer to one another, the volume of the cavity 24 is reduced in such a way as to compress this fluid thus generating pressure on the radially internal face of the plate 12. This pressure pushes the plate 12 against the molding cavity 15.

In the context of the disclosure herein, the mold 14 arranged at the (radially external) periphery 8A of the tool 8 can be produced in various ways.

As a preference, the mold 14 comprises a shell (provided with the molding cavity 15) which is formed of several (individual) shell parts able, on the one hand, to be separated from one another and, on the other hand, to be assembled. Each of these shell parts comprises a molding cavity part. These molding cavity parts are such that the molding cavity 15 is completely reconstructed when the various shell parts are assembled by being brought into contact with one another.

In a first embodiment, depicted in FIG. 5, the mold 14 comprises two shell parts 25 and 26, preferably two half-shells. Each of these shell parts 25 and 26 respectively comprises a molding cavity part 27, 28. The molding cavity 15 is thus reconstructed when the two shell parts 25 and 26 are brought into contact with one another as depicted in FIG. 5.

The half-shell 25 is fixed to the periphery of the tool part 9, namely radially on the outside, via a connecting face 25A. The fixing is, for example, achieved by welding or by bolting.

In addition, the half-shell 26 is fixed to the periphery of the tool part 10, namely radially on the outside, via a connecting face 26A. The fixing is likewise achieved for example by welding or by bolting.

The half-shells 25 and 26 are fixed in such a way that, when the two tool parts 9 and 10 reach their position of maximum proximity, as depicted in FIG. 5, the mutually-opposing faces 25B and 26B of the half-shells 25 and 26 come into contact with one another and the mold 14 is reformed with its molding cavity 15 (made up of the molding cavity parts 27 and 28) fully reconstructed.

In this position of FIG. 5, the plate 12 can be pressed firmly against the molding cavity 15.

Figure 6:
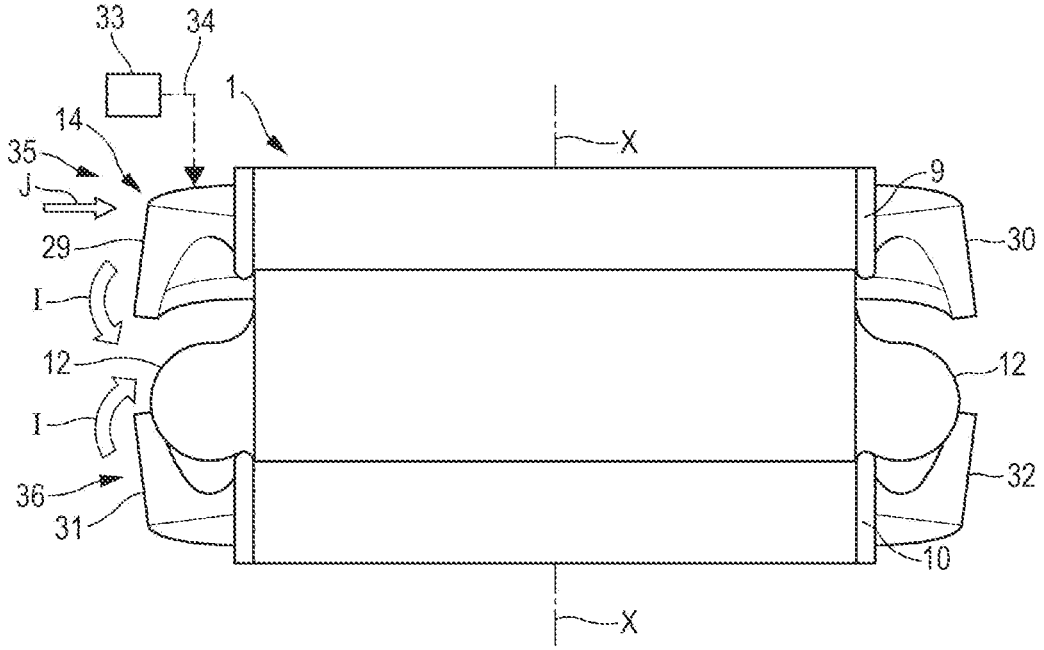
FIG. 6 is a schematic view in section of a manufacturing device comprising a mold according to a second embodiment.
Figure 7:
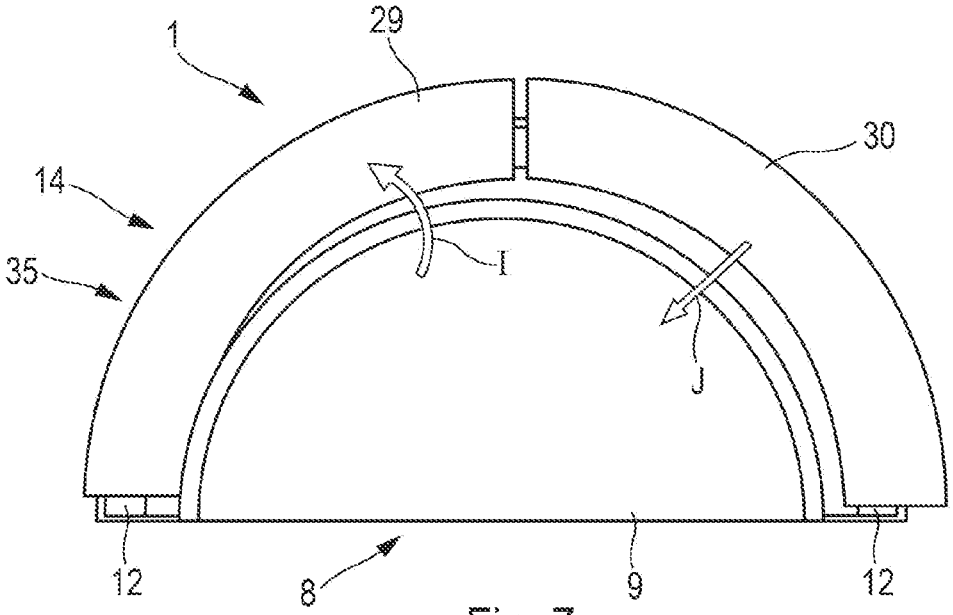
FIG. 7 is a partial plan view of the manufacturing device of FIG. 6.

In a second embodiment, depicted in FIGS. 6 and 7, the mold 14 comprises a plurality of shell parts 29, 30, 31 and 32, each of which is connected, in a mobile manner, to one of the tool parts 9 and 10, and a mechanical actuation system 33, for example a system of link rods and cams.

What is meant by "connected in a mobile manner" is that the shell part 29, 30, 31 and 32 concerned remains connected to the corresponding tool part 9, 10, but that it is able to be displaced in rotation (as indicated by arrows I in FIGS. 6 and 7) and/or in translation (as indicated by arrows J in FIGS. 6 and 7) by the actuation system 33, the action of which is illustrated by an arrow 34 in chain line. Thus, each of these mobile shell parts 29 to 32 is able to adopt at least two different positions, namely a separated (from the corresponding tool part) position and an assembled position, and is able to be displaced from one of these positions to the other by rotation and/or by translation.

When all the shell parts are brought into the assembled position, the mold 14 is reformed with its molding cavity 15 fully reconstructed.

Depending on the embodiment, the shell parts may be brought into the assembled position either as the two tool parts 9 and 10 move closer together, or at the end of the moving together.

In the example of FIGS. 6 and 7, the mold 14 comprises a set 35 of shell parts 29 and 30 which are connected (in a mobile manner) to the tool part 9 and a set 36 of shell parts 31 and 32 which are connected (in a mobile manner) to the tool part 10.

In the example of FIGS. 6 and 7, each set 35, 36 of shell parts comprises a plurality of shell parts in the form of an arc of a circle, for example four shell parts as for the set 35 partially depicted in FIG. 7. The shell parts of a set 35, 36 form a half-shell when brought into contact with one another. The two half-shells (obtained from the two sets 35 and 36 respectively) make it possible to form the mold 14.

Furthermore, in an embodiment variant (not depicted), some of the shell parts of the mold may be fixed to the tool parts 9 and 10 as in the abovementioned first embodiment and the other shell parts of the mold may be connected in a mobile manner to the tool parts 9 and 10 as in the abovementioned second embodiment.

Moreover, in a third embodiment, the device 1 comprises an auxiliary actuation system 39 depicted in FIG. 1.

In this third embodiment, the mold 14 comprises a plurality of shell parts 37, 38 in the form of an arc of a circle, for example four shell parts, which can be brought into contact by the auxiliary actuation system 39 (the action of which is illustrated by an arrow 40 in chain line) to reconstitute the mold 14.

In this third embodiment, the shell parts 37 and 38 are initially parted radially (toward the outside) from the tool 8. The auxiliary actuation system 39 is configured to displace the shell parts 37 and 38 in the direction illustrated by arrows K in FIG. 1 so as to bring them into contact with one another to form the mold 14 and to bring them into contact with the periphery 8A of the tool 8.

Figure 8:
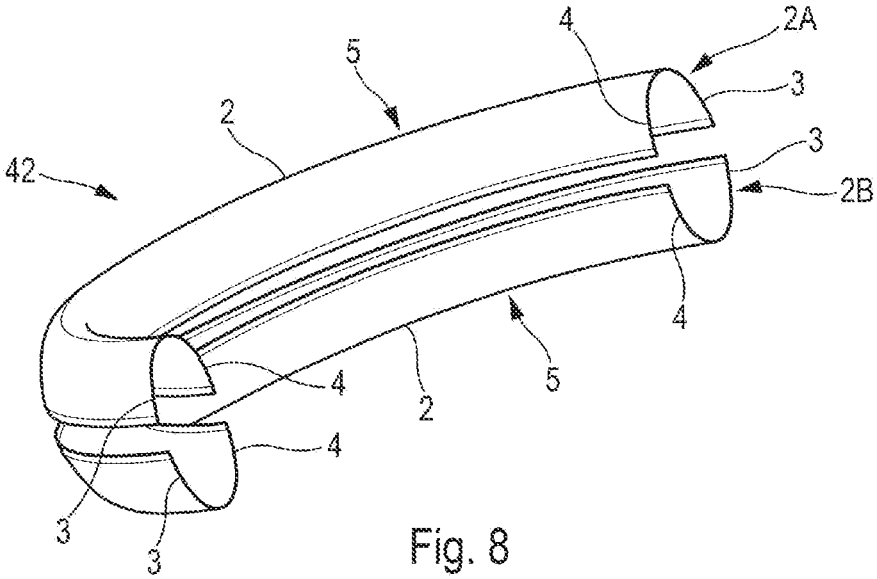
FIG. 8 is a partial view, in perspective and in section, of two components manufactured simultaneously using the manufacturing device of FIG. 1.

In the examples depicted in FIGS. 1, 4, 5 and 6 in particular, the mold 14 and the molding cavity 15 have a shape such that they are able to manufacture a component 42 (FIG. 8) substantially in the shape of a ring. This component 42 can be used, after being cut along lines 43 depicted in FIG. 1, to form two components 2 as depicted in FIG. 8. Each of these two components 2 is identical to the component 2 shown in FIG. 2.

In the context of the disclosure herein, the mold 14 and the molding cavity 15 may have appropriate shapes and/or sizes allowing the manufacture of components of varying size and/or shape. In addition to annular components, they are also able for example to manufacture rectilinear components, curved components, notably shaped as arcs of a circle, or components of any shape. In addition, the depth and/or the size of the components can vary greatly.

In the context of the disclosure herein, the manufacturing performed by the device 1 as described hereinabove can be performed cold. The device 1 is then used at ambient temperature.

In the context of the disclosure herein, the manufacturing can also be performed hot. To do this, in one particular embodiment, the device 1 additionally comprises an oven 41 depicted schematically in FIG. 4. This oven 41 is able to accept the tool 8 and the mold 14 and is configured to generate a predetermined temperature, for example between 500° C. and 950° C. This particular embodiment thus allows the component 2 to be manufactured by heating the plate 12 before deforming it and while deforming it.

In a first variant of this particular embodiment, only the plate 12 is positioned inside the oven, the tool 8 and the mold 14 being left at ambient temperature. This embodiment variant therefore allows the component 2 to be manufactured by heating only the plate 12 before it is positioned and deformed in the mold 14.

In a second embodiment variant, the mold 14 may be a heating mold and be configured to heat the plate 12 directly. This embodiment variant therefore allows hot manufacture without the use of an oven.

The device 1 as described hereinabove is able to implement a method P for the manufacture of a component made of deformable material, for example such as that depicted in FIG. 2.

Figure 9:
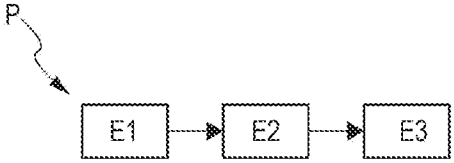
FIG. 9 schematically shows the main steps of a manufacturing method.

To this end, the method P comprises, as depicted in FIG. 9, the following steps:

- a deformation step E1 consisting in or comprising fixing a plate 12 made of a deformable material via two of its ends respectively to the two tool parts 9 and 10 of the tool 8. The deformation step E1 also consists in bringing the two parts of the tool 9 and 10 closer to one another, using the actuation system 11, so as to round the plate 12; and
- a forming step E2 consisting in or comprising pressing the plate 12 firmly against the molding cavity 15 of a mold 14 which is arranged at the periphery of the tool 8 so that the plate 12 conforms to the shape of the molding cavity 15.

Because the molding cavity 15 has a shape corresponding to the shape of at least part of the component 2 that is to be manufactured and is oriented in such a way as to face the rounded plate 12, this action allows the rounded plate 12 to be shaped in such a way as to give it its definitive shape.

The method P also comprises a finishing step E3 consisting in or comprising releasing the component obtained at the end of the forming step E2 from the mold and performing finishing operations on the component, particularly by trimming off any excess material there might be and/or by making cuts along lines 43 (shown in FIG. 1) to obtain two components 2. At the end of the finishing step E3 the component or components 2 manufactured using the method P are obtained.

In a first embodiment, the forming step E2 is performed after the deformation step E1.

Furthermore, in a second embodiment, the deformation step E1 and the forming step E2 are performed at least partially simultaneously.

Furthermore, the manufacture performed by the method P can be performed cold or hot.

When the manufacture is performed hot, the tool 8 and the mold 14 are incorporated into the oven 41 as depicted in FIG. 4, and at least the forming step E2 is performed hot, namely at the temperature generated by the oven 41.

In a first variant, only the plate 12 is incorporated into the oven, the tool 8 and the mold 14 being left at ambient temperature. In that case, the plate 12 is first of all heated in the oven and then positioned in the mold 14 in order to be deformed.

In a second variant, the use of a heating mold 14 is envisioned.

As a preference, both the deformation step E1 and the forming step E2 are performed hot.

The device 1 and the method P as described hereinabove, which allow the manufacture of one-piece components by the displacement and deformation of material, offer numerous advantages.

In particular, by virtue of the generation of a plate 12 that is rounded (using the tool 8) and subjected to forming in the mold 14, and by virtue of the arrangement of the mold 14 at the periphery of the tool 8, which makes it possible to envision different embodiments suited to the components that are to be manufactured, the device 1 and the method P make it possible to manufacture components 2 of varying size and/or shape, particularly annular components, rectilinear components or curved components, particularly shaped as arcs of a circle.

They notably allow the manufacture of components of very large size and/or deep components, which is to say components having very long longitudinal walls 3 and 4

(FIG. 2). To do this, it is necessary to provide a molding cavity 15 of the required shape and a plate 12 of sufficient length.

The device 1 and the method P may be used to manufacture components made of different materials, notably metallic materials, and in particular made of titanium alloy or aluminum alloy.

In addition, notably because of the arrangement of the mold 14 at the periphery of the tool 8, a balanced distribution of the internal stresses in the device 1 is obtained.

Furthermore, in a preferred embodiment, using a mold of suitable shape, the device 1 allows the manufacture, in a single implementation of the method P, of two components 2 such as those depicted in FIG. 8, simultaneously.

While at least one example embodiment of the invention (s) is disclosed herein, it should be understood that modifications, substitutions and alternatives may be apparent to one of ordinary skill in the art and can be made without departing from the scope of this disclosure. This disclosure is intended to cover any adaptations or variations of the example embodiment(s). In addition, in this disclosure, the terms "comprise" or "comprising" do not exclude other elements or steps, the terms "a", "an" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

The invention claimed is:

1. A device for manufacturing at least one component made of deformable material for an edge of an element, the device comprising:

a tool with two tool parts of which at least one is mobile, the two tool parts being configured to move closer to one another, wherein the two tool parts are configured to be fixed to a first longitudinal end and a second longitudinal end, respectively, of a plate made of deformable material, wherein the two tool parts are configured to deform the plate made of deformable material in a direction radially away from a longitudinal axis of the tool when the two tool parts are moved closer to one another;

a mold at a periphery of the tool and comprising a molding cavity of a shape corresponding to a shape of at least part of the component that is to be manufactured, the molding cavity being oriented to face the rounded plate; and a displacement system configured to press the rounded plate firmly against the molding cavity of the mold, the mold being able to shape the rounded plate when it is pressed firmly against the molding cavity to give it its definitive shape.

2. The device of claim 1, wherein the tool comprises at least one of actuating systems as follows for moving the two tool parts closer to one another: a mechanical system, a hydraulic system.

3. The device of claim 1, wherein the displacement system comprises at least one of: a fluid supply unit, a fluid displacement unit.

4. The device of claim 1, wherein the mold comprises a plurality of shell parts able to be separated and assembled, which are connected to the tool in one of:

at least one of the shell parts is fixed to one of the tool parts;

at least one of the shell parts is connected in a mobile manner to one of the tool parts.

5. The device of claim 1, wherein the mold comprises a plurality of shell parts able to be separated and assembled, and wherein the device is configured to displace the shell parts in order to assemble them.

6. The device of claim 1, wherein the molding cavity of the mold has a shape that allows at least two components to be manufactured simultaneously.

7. The device of claim 1, wherein the device additionally comprises an oven able to heat at least the plate.

8. A method for manufacturing at least one component made of deformable material for an edge of an element, the method comprising:

a gripping step comprising fixing a plate made of deformable material by two of its ends respectively to two tool parts of a tool;

a deformation step comprising bringing the two tool parts closer to one another to deform the plate in a direction radially away from a longitudinal axis of the tool; and a forming step comprising pressing the rounded plate firmly against a molding cavity of a mold arranged at a periphery of the tool, the molding cavity having a shape corresponding to a shape of at least part of the component that is to be manufactured and being oriented to face the rounded plate to shape the rounded plate to give it its definitive shape.

9. The method of claim 8, wherein the deformation step and the forming step are performed at least partially simultaneously.

10. The method of claim 8, wherein at least the forming step is performed hot.

11. A device for manufacturing at least one component made of deformable material for an edge of an element, the device comprising:

a tool with two tool parts of which at least one is mobile, the two tool parts being configured to be able to move closer to one another and to round a plate made of deformable material which is fixed by two of its ends to the two tool parts respectively when the two tool parts are moved closer to one another;

a mold at a periphery of the tool and comprising a molding cavity of a shape corresponding to a shape of at least part of the component that is to be manufactured, the molding cavity being oriented to face the rounded plate; and a displacement system configured to press the rounded plate firmly against the molding cavity of the mold, the mold being able to shape the rounded plate when it is pressed firmly against the molding cavity to give it its definitive shape;

wherein the mold comprises a plurality of shell parts able to be separated and assembled, and wherein the device is configured to displace the shell parts in order to assemble them.

12. The device of claim 11, wherein at least one of the shell parts is fixed to one of the tool parts.

13. The device of claim 11, wherein at least one of the shell parts is connected in a mobile manner to one of the tool parts.

* * * * *